US005727613A

United States Patent [19]

Judkins

[11] Patent Number: 5,727,613

[45] Date of Patent: Mar. 17, 1998

[54] LADDER FOR VENETIAN TYPE BLINDS

[76] Inventor: Ren Judkins, 46 Newgate Rd., Pittsburgh, Pa. 15202

[21] Appl. No.: 745,692

[22] Filed: Nov. 12, 1996

[51] Int. Cl.[6] ..... E06B 9/38

[52] U.S. Cl. ..... 160/178.3 R

[58] Field of Search ..... 160/178.3 R, 168.1 R, 160/176.1 R, 173 R, 166.1 R; 139/384 A

[56] References Cited

U.S. PATENT DOCUMENTS

| | | | |
|---|---|---|---|
| 2,031,981 | 2/1936 | Runge | 156/17 |
| 2,275,273 | 3/1942 | Taylor | 66/170 |
| 2,303,939 | 12/1942 | Kahn | 160/178.3 R |
| 2,571,372 | 10/1951 | Martin | 160/178 |
| 2,572,224 | 10/1951 | Walker | 160/173 |
| 2,587,756 | 3/1952 | Palmisano | 160/168 |
| 2,620,850 | 12/1952 | Janowski | 154/1.6 |
| 2,632,506 | 3/1953 | Walker | 160/178 |
| 2,856,324 | 10/1958 | Janowski | 154/118 |
| 3,086,586 | 4/1963 | Wolfe | 160/236 |
| 3,256,928 | 6/1966 | Hensel | 160/178 |
| 4,945,971 | 8/1990 | Ivarsson et al. | 160/178.3 |
| 4,951,729 | 8/1990 | Chi Yu | 160/168.1 R X |
| 5,060,709 | 10/1991 | Simon | 160/168.1 |
| 5,613,540 | 3/1997 | Jelic | 160/178.3 X |

*Primary Examiner*—David M. Purol
*Attorney, Agent, or Firm*—Buchanan Ingersoll, P.C.

[57] ABSTRACT

A ladder venetian type blinds has rungs containing at least two spaced apart threads. The threads may extend from the sides or rear of the ladder rails which causes them to be spaced apart. Consequently, there will be less drag on lift cords passing through the rungs.

17 Claims, 5 Drawing Sheets

LADDER FOR VENETIAN TYPE BLINDS

FIELD OF INVENTION

The invention relates to ladders which hold the slats in venetian type blinds.

BACKGROUND OF THE INVENTION

Venetian type blinds have a series of slats hung on ladders which extend from a headrail to a bottomrail. The ladders have two parallel rails and a series of rungs. The rungs extend from or are attached to the surfaces of the rails which face one another. In most venetian blinds a pair of lift cords is provided each having one end attached to the bottomrail and then passing through elongated holes in the slats up to and through the headrail. When the lift cords are pulled downward the blind is raised and when the lift cords are released the blind is lowered. A cord lock is usually provided in the headrail through which the lift cords pass. The cord lock allows the user to maintain the blind in any desired position from fully raised to fully lowered.

In a venetian blind the slats rest on rungs between rails of the ladders. The blind is in an open position when the rungs are horizontal. To close the blind one lifts one rail while allowing the other to either remain in place or be lowered. This raises one end of each rung tilting the slats. Thus, when the blind is closed there is typically tension on one rail while the other rail of the ladder is not in tension.

The rails originally used for venetian blinds consisted of a fabric tape typically from one to two inches in width. The rungs were also made of fabric strips. Conventionally, the lift cords pass through holes in the slats which were aligned between the rails of the ladder. When the blind was closed, the fabric rails covered the holes. Consequently, there was no concern about light passing through the holes when the blind was in a closed position.

Walker in U.S. Pat. No. 2,572,224 discloses slats for a venetian type blind having a tape type ladder system and two lift cords. One lift cord passes through notches on the inside edges at one end of the slats. The second lift cord passes through notches on the outside edge of the other end of the slats. Each lift cord is positioned behind one of the tape-type ladders. In my U.S. patent application Ser. No. 08/384,136, filed Feb. 6, 1995, I disclose a venetian blind having pairs of lift cords on opposite edges of the slats adjacent the rails of the ladders Very few tape type ladders are used in blinds today. Rather, the art has adopted ladders formed of cord rails having cord-type rungs between them. Typically, the rungs are multiple strands of cord. I have made venetian type blinds such as are disclosed in my application Ser. No. 08/384,136 and run the lift cord between the strands of the rungs. Although this maintained the lift cords in alignment, the cords rubbed against the strands creating drag. This drag made larger blinds significantly harder to raise and especially harder to lower than the same size conventional blinds with lift cords running through holes in the slats.

There is a need for a ladder for venetian type blinds which will maintain alignment of lift cords which are adjacent the edges of the slats yet not make the blind more difficult to operate.

SUMMARY OF THE INVENTION

I provide a ladder venetian type blinds having rungs comprised of at least two spaced apart threads. The threads may extend from the sides or rear of the ladder rails which causes them to be spaced apart. Consequently, there will be less drag on lift cords passing through the rungs.

Other objects and advantages of the present invention will become apparent from a description of the present preferred embodiments shown in the drawings.

DESCRIPTION OF THE PREFERRED EMBODIMENTS

Figure 1:
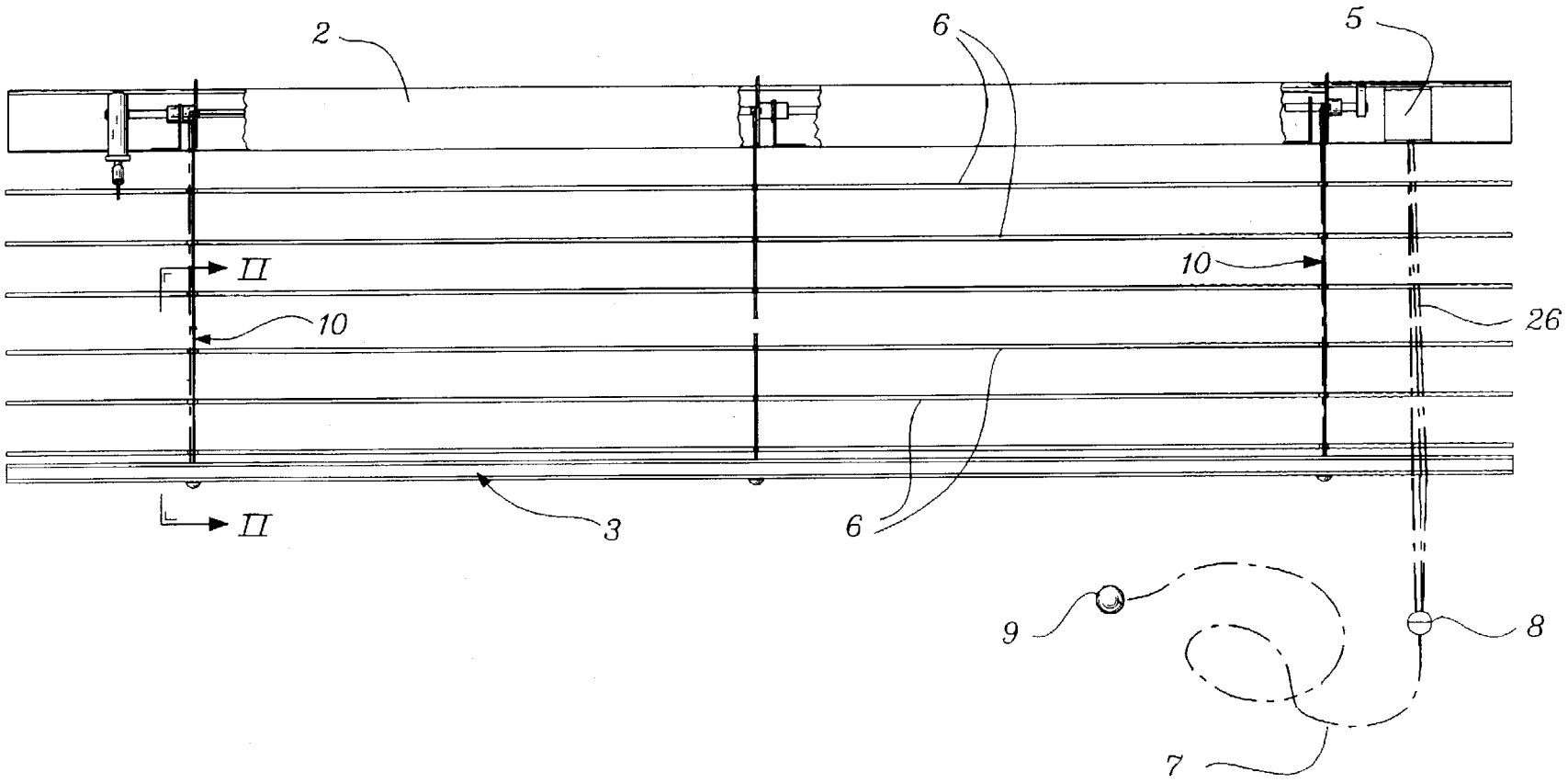
FIG. 1 is a front view a venetian type blind having the first present preferred embodiment of my ladder and shown in a lowered open positioned.
Figure 2:
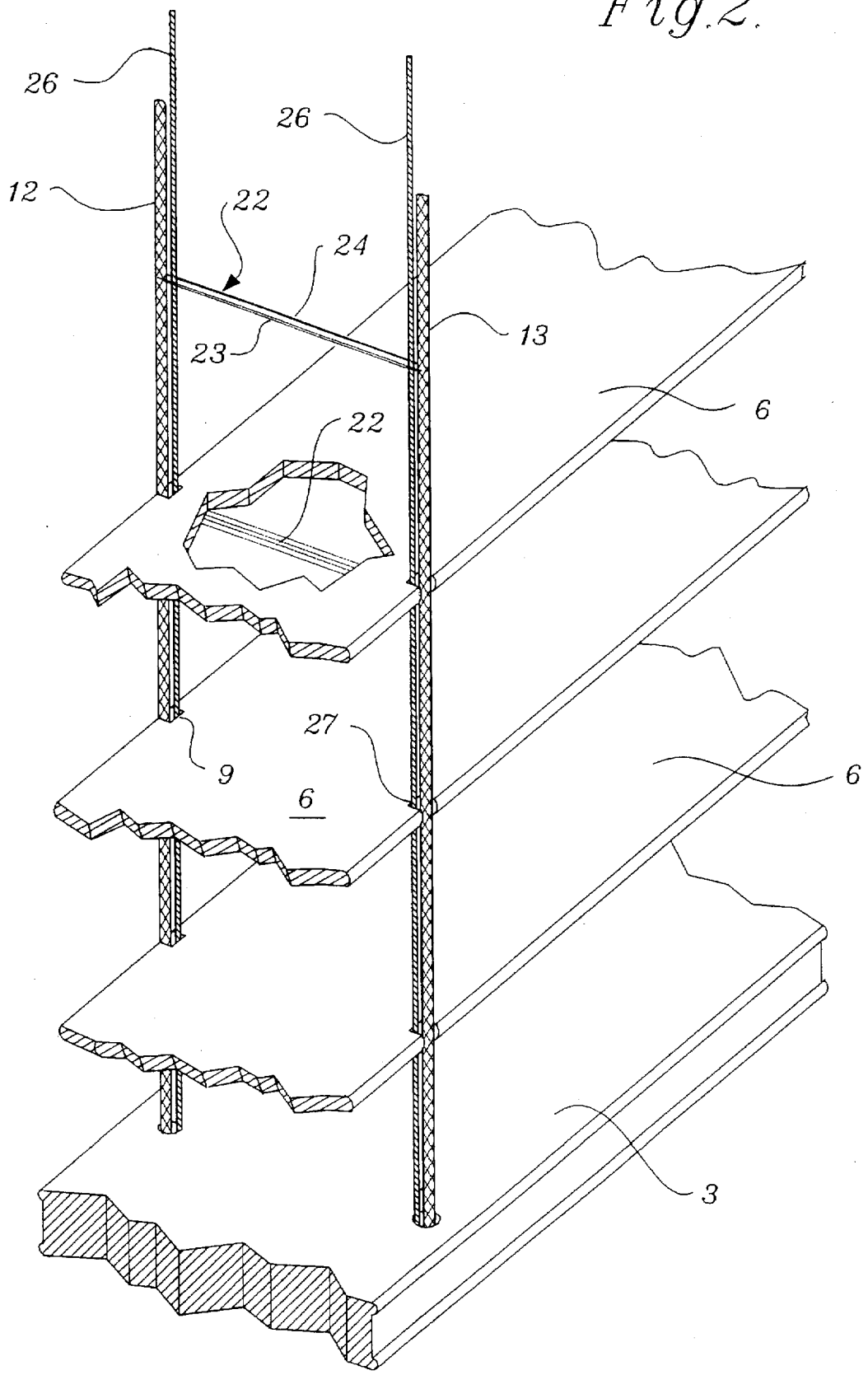
FIG. 2 is a fragmentary view showing the right end of the portion of the lowered blind taken along the line II—II of FIG. 1.
Figure 4:
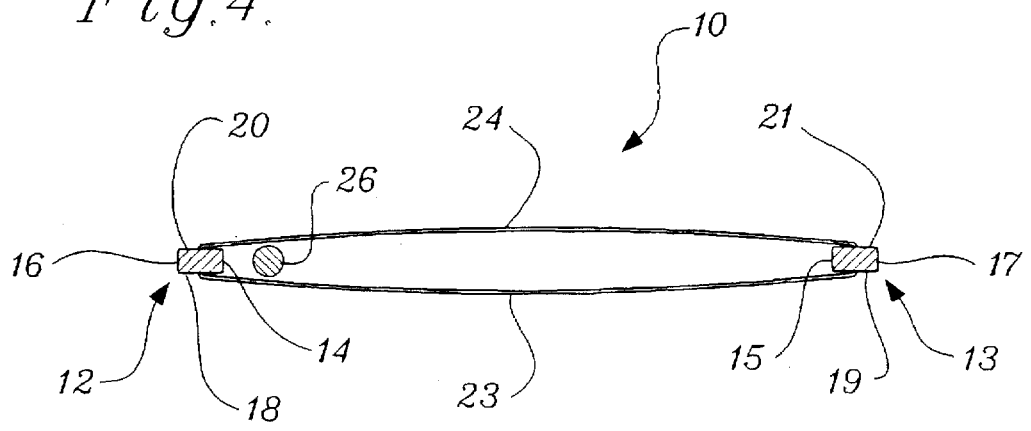
FIG. 4 is a sectional view taken along the line IV—IV of FIG. 3.
Figure 3:
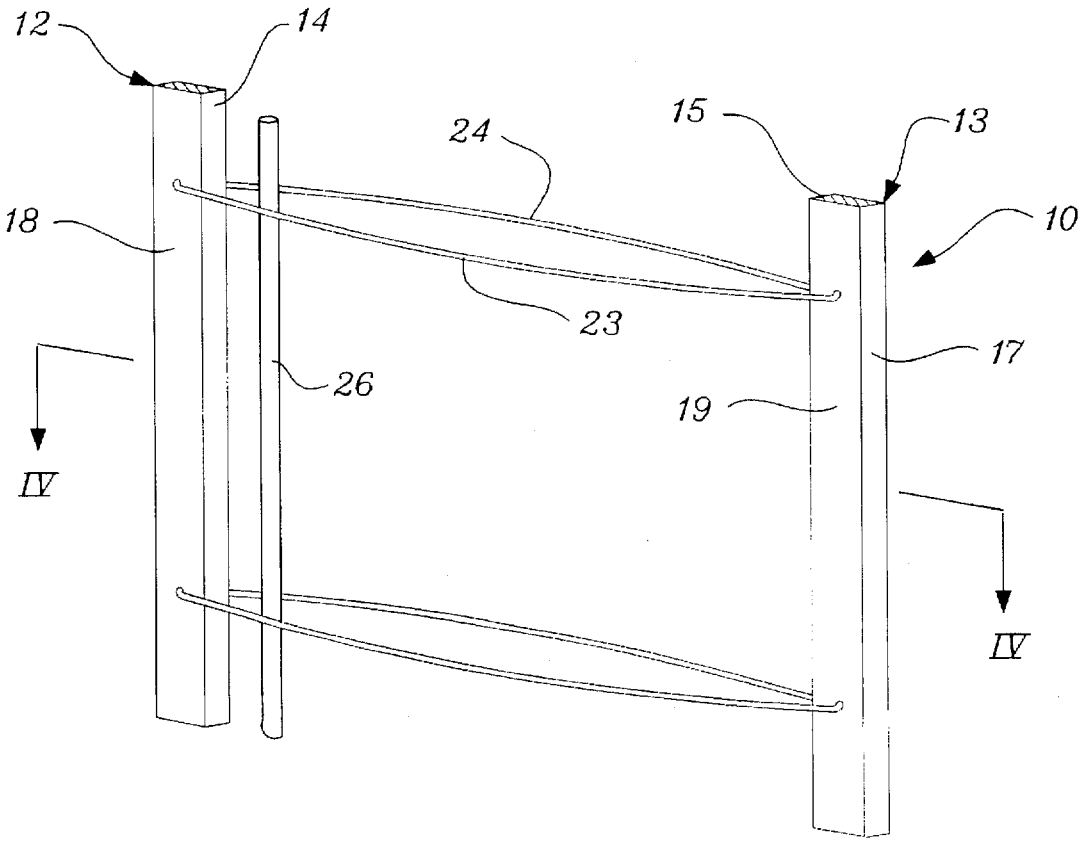
FIG. 3 is a perspective view of a first present preferred embodiment of my ladder having a lift cord passing through the rungs.

As shown in FIGS. 1 and 2, the venetian blind containing a first present preferred ladder is comprised of a headrail 2, bottomrail 3 and a set of slats 6 extending therebetween. For purposes of illustration only six slats are shown. However, the blind could have any number of slats and likely would have many more slats than are shown. The slats of this embodiment are symmetrical to a horizontal plane passing through the front and back edges of the slat. Crowned slats may be used in place of these flat slats if desired. The slats are suspended on a cord type ladder 10. As shown in FIGS. 2 thru 4, the ladder has a first rail 12, second rail 13 and series of rungs 22 extending therebetween on which these slats rest. Lift cords 26 extend from the bottom rail 3 through the rungs in ladders 10. I provide two lift cords 26 that pass through the rungs 22 of each ladder 10. The lift cords 26 also pass through slots 27 cut in the edges of slats 6 as shown in FIG. 2. The lift cords run through the headrail 2 and cord lock 5 to ball 8. If desired cord 7 and tassel 9 may be attached to ball 8. When the blind is raised the rails will fold side to side in a plane parallel to the from edge of the slats.

In a first preferred embodiment shown in FIGS. 3 and 4, I provide a ladder having a first rail 12 spaced apart from the second rail 13. A series of rungs 22 extend between the rails. In the first preferred embodiment each rung is comprised of two threads 23 and 24. The rails 12 and 13 have a generally rectangular or oval cross section. There is a face 14 on rail 12 which is opposite and facing a face 15 on rail 13. Rails 12 and 13 each have a back 16 and 17. There is a left side 18 of the first rail and a right side 20 of the first rail. These sides extend between face 14 and rear 16 of the rail. Similarly, rail 13 has a left side 19 and a right side 21 which extend between from 15 and back 17. In the first embodiment the left thread 23 of the rung extends from left side 18 of rail 12 to left side 19 of rail 13. The fight rung thread 24 extends from right side 20 of rail 12 to right side 21 of rail 13. With this arrangement, the rungs 23 and 24 will remain spaced apart by at least a diameter of the rails 12 and 13. Therefore, lift cord 26 may freely pass between threads 23 and 24 of each rung 22.

Figure 6:
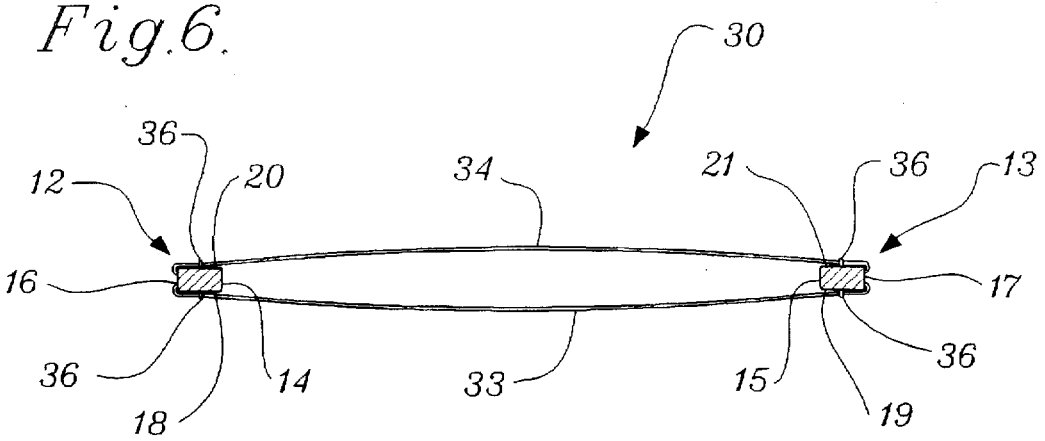
FIG. 6 is a sectional view taken around the line VI—VI of FIG. 5.
Figure 5:
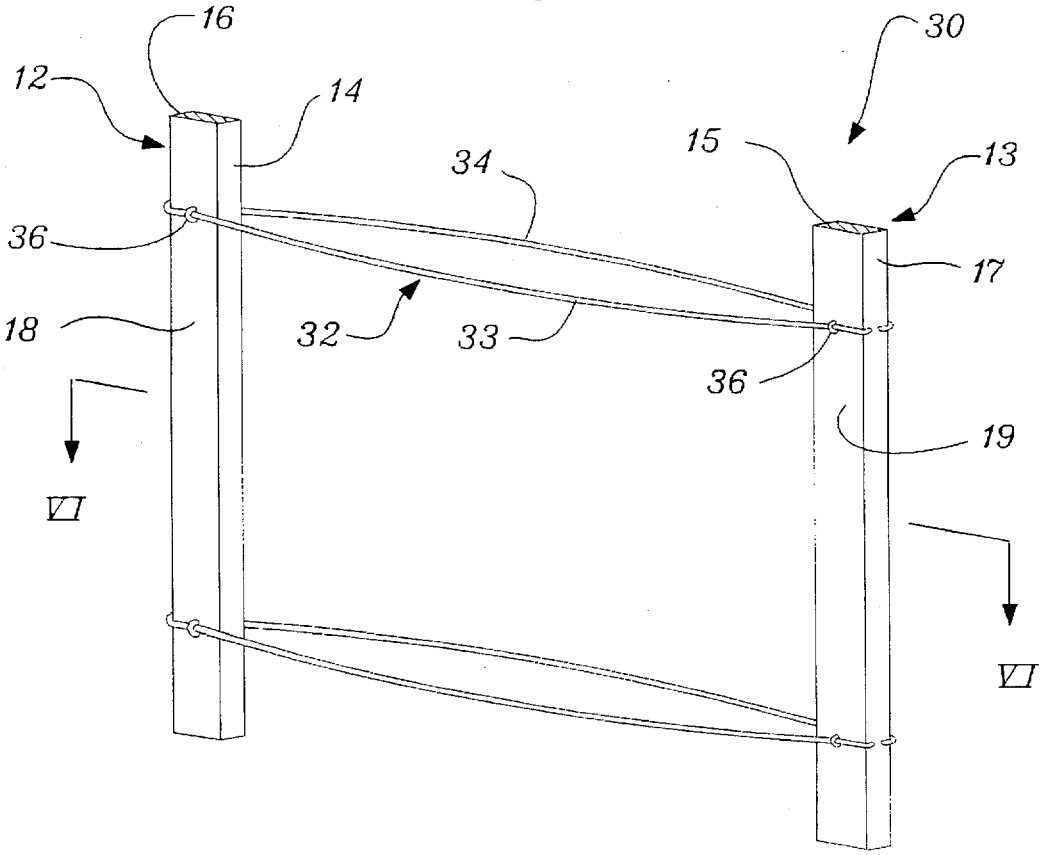
FIG. 5 is a perspective view of a second present preferred embodiment of my ladder. .

In a second preferred embodiment 30 shown in FIGS. 5 and 6, I utilize the same rails 12 and 13. Hence, the faces and sides of the rails are similarly numbered in FIGS. 3 and 4. In the second preferred embodiment, however, rungs 32 are comprised of a left rung thread 33 and right run thread 34 which is attached to the back 16 of rail 12 and the back 17 of rail 13. Left rung 33 extends over the left sides 18 and 19 of rails 12 and 13. Right rung thread 34 extends over the faces 20 and 21 of rails 12 and 13. If desired, stitching 36 may be provided to secure rung threads 33 and 34 to the faces of the rails over which they pass. Because of the attachment of the rung threads in this manner they will remain spaced apart by a thickness approximately equal to the diameter of rails 12 and 13. Consequently, them will be less drag on lift cords passing through the rungs.

Figure 7:
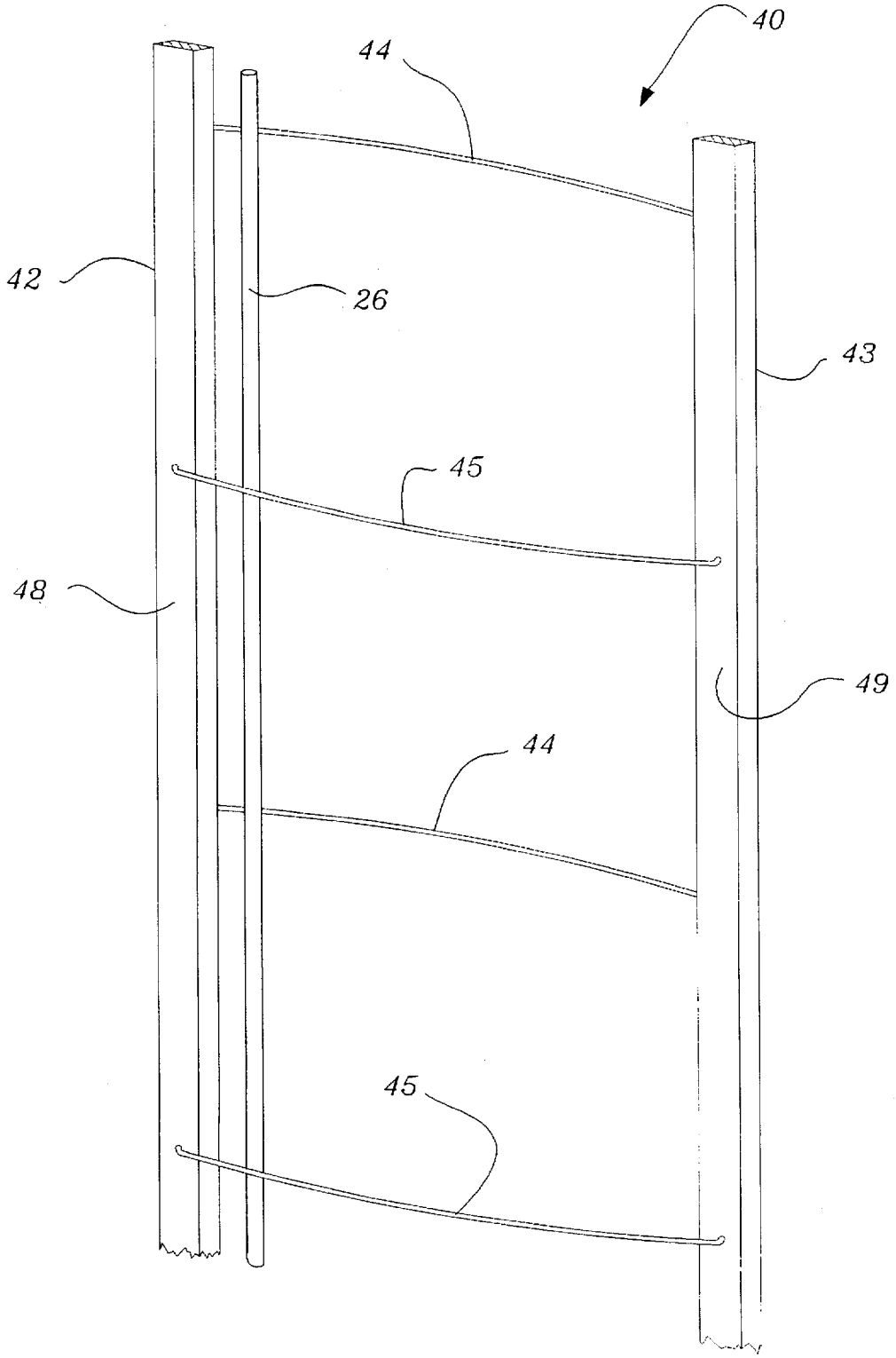
FIG. 7 is a perspective view of a third present preferred embodiment of my ladder.

The third embodiment 40 shown in FIG. 7 is similar to the first preferred embodiment shown in FIGS. 3 and 4 except that the right threads and left threads are spaced apart along the rails so that each thread can individually support a slat. In this ladder 40 the first rail 42 is spaced apart from the second rail 43. Each rung is comprised of a single thread extending from either the right side or the left side of the rails 42 and 43. Each thread may be comprised of several strands of material. Each left thread 45 of the rung extends from the left side 48 of rail 42 to the left side 49 of rail 43. Each right rung thread 44 extends from the right side of rail 42 to the right side of rail 43. Thus, there are several pairs of left and right rung threads along the length of the ladder 40 In this embodiment, the lift cord 26 is woven between each pair of threads 44 and 45 as shown. A similar ladder could be made by attaching the left and right rung threads to the back of the ladder as shown in FIGS. 5 and 6, but spacing each left thread from each right thread along the rails as shown in FIG. 7.

While I have shown the rungs in my present preferred embodiments to contain two threads, one on the right side of the ladder and a second on the left side of the ladder, additional threads may be provided on either or both sides. My ladder can be made on a conventional knitting machines which are now used to manufacture cord type ladders. However, these machines must be modified somewhat to assure that the threads in the rungs extend from the side or the back of the ladder. I have discovered that an embodiment similar to that shown in FIGS. 5 and 6 can be made from a conventional ladder having multiple threads extending from opposite faces of the rails. This is done by taming a ladder inside out. That is, the ends of rails 12 and 13 are turned inward to pass between two threads or two groups of threads in each rung. When this is done what was once the outer surfaces of the rails has now become the opposite inside faces 14 and 15 of the second preferred embodiment.

Although I have shown certain present preferred embodiments of my invention it should be understood that the invention is not limited thereto, but may be variously practiced within the scope of the following claims.

I claim:

1. A ladder for venetian type blinds comprising:

a. a first rail and a second rail substantially parallel to the first rail each rail having an inward facing front, an outward facing back, a left side and a right side, the left side and right side being substantially parallel and running from the from to the back, the rails being positioned so that the face of the first rail is opposite from and facing the face of the second rail; and b. a plurality of rungs attached to the rails each rung having:

i. at least one left thread attached to the back of and passing over the left side of the first rail and attached to the back of and running over the left side of the second rail; and ii. at least one right thread attached to the back of and running over the right side of the first rail and attached to the back and running over the fight side of the second rail, whereby the at least one left thread will be spaced apart from the at least one right thread.

2. The ladder of claim 1 wherein there are two left threads and two right threads.

3. The ladder of claim 1 wherein the at least one left thread and the at least one right thread are woven from a single strand of material.

4. A ladder for venetian type blinds comprising:

a. a first rail and a second rail substantially parallel to the first rail each rail having an inward facing front, an outward facing back, a left side and a right side, the left side and right side being substantially parallel and running from the front to the back, the rails being positioned so that the face of the first rail is opposite from and facing the face of the second rail;

b. a plurality of rungs attached to the rails each rung having:

i. at least one left thread attached to the back of and passing over the left side of the first rail and attached to the back of and running over the left side of the second rail; and ii. at least one right thread attached to the back of and running over the right side of the first rail and attached to the back and running over the right side of the second rail: and c. for each rung a first rail attachment connecting the at least one left thread to the left side of the first rail and connecting the at least one right thread to the right side of the first rail and a second rail attachment connecting the at least one left thread to the left side of the second rail and connecting the at least one right thread to the right side of the second rail.

5. A ladder for venetian type blinds comprising:

a. a first rail and a second rail substantially parallel to the first rail each rail having an inward facing front, an outward facing back, a left side and a right side, the left side and right side being substantially parallel and running from the front to the back, the rails being positioned so that the face of the first rail is opposite from and facing the face of the second rail; and b. a plurality of rung pairs attached to the rails each rung pair having:

i. a left thread attached to the back and passing over the left side of the first rail and attached to the back and passing over the left side of the second rail; and ii. a right thread attached to the back and passing over the right side of the first rail and attached to the back and passing over the right side of the second rail, the left thread being spaced apart from the right thread in a direction along the rails.

6. The ladder of claim 5 wherein the left thread and the right thread are each woven from a single strand of material.

7. An improved venetian blind of the type comprised of a headrail, a bottom rail a plurality of slats positioned between the headrail and the bottom rail and lift cords extending from the headrail to the bottom rail wherein the improvement comprises a plurality ladders each ladder attached to the headrail and the bottom rail and supporting the slats each ladder comprised of:

a. a first rail and a second rail substantially parallel to the first rail each rail having an inward facing front, an outward facing back, a left side and a fight side, the left side and right side being substantially parallel and running from the front to the back, the rails being positioned so that the face of the first rail is opposite from and facing the face of the second rail; and b. a plurality of rungs attached to the rails each rung having i. at least one left thread connected between the left side of the first rail and the left side of the second rail; and ii. at least one right thread connected between the right side of the first rail and the right side of the second rail, whereby the at least one left thread will be spaced apart from the at least one right thread and wherein at least one of the lift cord passes between the at least one left thread and the at least one right thread of at least one ladder.

8. The improved venetian blind of claim 7 wherein there are two left threads and two right threads.

9. The improved venetian blind of claim 7 wherein the at least one left thread and the at least one fight thread are woven from a single strand of material.

10. An improved venetian blind of the type comprised of a headrail, a bottom rail a plurality of slats positioned between the headrail and the bottom rail and lift cords extending from the headrail to the bottom rail wherein the improvement comprises a plurality ladders each ladder attached to the headrail and the bottom rail and supporting the slats each ladder comprised of:

a. a first rail and a second rail substantially parallel to the first rail each rail having an inward facing front, an outward facing back, a left side and a right side, the left side and right side being substantially parallel and running from the front to the back, the rails being positioned so that the face of the first rail is opposite from and facing the face of the second rail; and b. a plurality of rungs attached to the rails each rung having i. at least one left thread attached to the back of and passing over the left side of the first rail and attached to the back of and running over the left side of the second rail; and ii. at least one right thread attached to the back of and running over the right side of the first rail and attached to the back and running over the right side of the second rail, whereby the at least one left thread will be spaced apart from the at least one right thread and wherein at least one of the lift cord passes between the at least one left thread and the at least one right thread of at least one ladder.

11. The improved venetian blind of claim 10 wherein there are two left threads and two right threads.

12. The improved venetian blind of claim 10 wherein the at least one left thread and the at least one right thread are woven from a single strand of material.

13. The improved venetian blind of claim 10 also comprising for each rung a first rail attachment connecting the at least one left thread to the left side of the first rail and connecting the at least one right thread to the right side of the first rail and a second rail attachment connecting the at least one left thread to the left side of the second rail and connecting the at least one right thread to the right side of the second rail.

14. An improved venetian blind of the type comprised of a headrail, a bottom rail a plurality of slats positioned between the headrail and the bottom rail and lift cords extending from the headrail to the bottom rail wherein the improvement comprises a plurality ladders each ladder attached to the headrail and the bottom rail and supporting the slats each ladder comprised of:

a. a first rail and a second rail substantially parallel to the first rail each rail having an inward facing front, an outward facing back, a left side and a right side, the left side and right side being substantially parallel and running from the front to the back, the rails being positioned so that the face of the first rail is opposite from and facing the face of the second rail; and b. a plurality of rung pairs attached to the rails each rung pair having:

i. a left thread connected between the left side of the first rail and the left side of the second rail; and ii. a right thread connected between the right side of the first rail and the right side of the second rail, the left thread being spaced apart from the right thread in a direction along the rails, wherein at least one of the lift cord passes between the left thread and the right thread of the rung pairs of at least one ladder.

15. The improved venetian blind of claim 14 wherein the at least one left thread and the at least one right thread are woven from a single strand of material.

16. An improved venetian blind of the type comprised of a headrail, a bottom rail a plurality of slats positioned between the headrail and the bottom rail and lift cords extending from the headrail to the bottom rail wherein the improvement comprises a plurality ladders each ladder attached to the headrail and the bottom rail and supporting the slats each ladder comprised of:

a. a first rail and a second rail substantially parallel to the first rail each rail having an inward facing front, an outward facing back, a left side and a right side, the left side and right side being substantially parallel and running from the front to the back, the rails being positioned so that the face of the first rail is opposite from and facing the face of the second rail; and b. a plurality of rung pairs attached to the rails each rung pair having:

i. a left thread attached to the back and passing over the left side of the first rail and attached to the back and passing over the left side of the second rail; and ii. a right thread attached to the back and passing over the right side of the first rail and attached to the back and passing over the right side of the second rail, the left thread being spaced apart from the right thread in a direction along the rails;

wherein at least one of the lift cord passes between the left thread and the right thread of the rung pairs of at least one ladder.

17. The improved venetian blind of claim 16 wherein the left thread and the right thread are each woven from a single strand of material.

* * * * *

UNITED STATES PATENT AND TRADEMARK OFFICE

CERTIFICATE OF CORRECTION

PATENT NO. : 5,727,613

DATED : March 17, 1998

INVENTOR(S) : REN JUDKINS

It is certified that error appears in the above-indentified patent and that said Letters Patent is hereby corrected as shown below:

Column 4, claim 1, line 7, change "fight" to --right--.

Column 5, claim 7, line 3, change "fight" to --right--.

Column 5, claim 9, line 23, change "fight" to --right--.

Signed and Sealed this

Thirtieth Day of June, 1998

*Attest:*

*Attesting Officer*

Bruce Lehman

BRUCE LEHMAN

*Commissioner of Patents and Trademarks*